US005114259A

United States Patent [19]

Meservy et al.

[11] Patent Number: 5,114,259

[45] Date of Patent: May 19, 1992

[54] ADJUSTABLE WRITING PLATFORM FOR A NOTEBOOK

[76] Inventors: Jay A. Meservy, 564 Pheasant Cir., Bountiful, Utah 84010; Jerry D. Meservy, 692 S. 850 East, Centerville, Utah 84014

[21] Appl. No.: 718,203

[22] Filed: Jun. 20, 1991

Related U.S. Application Data

[63] Continuation-in-part of Ser. No. 532,050, Jun. 1, 1990, Pat. No. 5,044,807.

[51] Int. Cl.[5] ..... B42F 13/00

[52] U.S. Cl. ..... 402/80 R; 402/73; 248/454

[58] Field of Search ..... 248/454, 459; 402/73, 402/74, 75, 76, 77, 78, 79, 80 R, 80 L, 502

[56] References Cited

U.S. PATENT DOCUMENTS 3,136,082 6/1964 Sloves ..... 402/73 X
3,936,202 2/1976 Brajituli ..... 402/80 R X
4,019,823 4/1977 Kleinert et al. ..... 402/80 R X
4,603,995 8/1986 Vilona ..... 402/80 R X
4,623,276 11/1986 Kinneir ..... 402/80 R X
4,981,386 1/1991 Beleckis ..... 402/73

*Primary Examiner*—Paul A. Bell
*Attorney, Agent, or Firm*—J. Winslow Young

[57] ABSTRACT

A writing platform for a notebook, the writing platform including a writing table that can be elevated from a flat configuration to an elevated position along one edge adjacent the ring binder of the notebook so as to provide a writing surface underneath one or more pages in the notebook. A riser is hingedly joined between a basal element and the writing table and supports the edge of the writing table at a preselected elevation. Detent means are included on the basal element and are engaged by the writing table to releasably support the riser in a generally vertical orientation. The dimensional characteristics of the writing table, the riser, and the detent means determine the ultimate elevation of the edge of the writing table.

18 Claims, 5 Drawing Sheets

ADJUSTABLE WRITING PLATFORM FOR A NOTEBOOK

RELATED APPLICATIONS

This application is a continuation-in-part application of our copending application Ser. No. 07/532,050 filed Jun. 1, 1190 for ADJUSTABLE WRITING PLATFORM FOR A NOTEBOOK now U.S. Pat. No. 5,044,807.

BACKGROUND

1. Field of the Invention

This invention relates to notebook accessories and, more particularly, to a writing platform apparatus and method for elevating pages within a looseleaf notebook.

2. The Prior Art

Notebooks of various looseleaf varieties have been known for decades. These notebooks are used for numerous purposes although the primary purpose, as the name "notebook" implies, is that of recording handwritten notes. One especially popular form of looseleaf notebook is a personal calendar/notebook combination commonly referred to as a "day planner". The usual format for a day planner is that it includes a separate page for each day of the year with each page segregated into hourly blocks along with an area for notes, reminders, expenditures, and the like. A separate section of the day planner includes a series of alphabetically arranged pages for use as a directory.

Clearly, the inherent value of such a looseleaf notebook is through regular usage by the owner. This means that the person using the looseleaf notebook should write in the notebook on a regular basis. However, it is well known that a notebook with a substantial number of pages represents a difficult writing surface due to the inherent nature of the looseleaf notebook. In particular, the pages held by the ring binder will vary greatly in thickness depending upon which page is to be written upon and also which side of the particular page is being used. These problems are particularly exacerbated by the fact that day planners are specifically configured to be as compact as possible for purposes of handling convenience. The result is that considerable distortion of the pages is encountered making writing on them particularly awkward. Further, depending upon which side of the page is being written upon and the thickness of the total number of pages underneath this particular page, writing in a notebook is quite cumbersome to the extent that many people become discouraged and do not write in the day planner as much as they should.

Perhaps the most serious difficulty is encountered when the writer must place his or her writing hand across the rings of the ring binder of the notebook. This is particularly troublesome for persons who write left handed on the right side of the notebook because of the nature of the hand position assumed while writing. Customarily, the left-handed person holds the writing hand above the area being written upon. The fingers holding the writing implement are curved downwardly toward the wrist. This writing position is adopted to enable the writer to be able to visually observe what is being written. In other words, the left-handed writer writes on a page from above which means that the forearm and wrist, at the minimum, are forced to contend with the ring binder while writing on the right side of the page. Correspondingly, the person writing with the right hand on the left side of the notebook encounters the ringbinder with the right hand as the page is written on from left to right. This means that a person writing on a page in close proximity to the rings of the ring binder encounters interference with the writing hand or wrist being brought into proximity with the ring binder.

An alternative solution to these problems is to remove the particular page from the notebook and place it upon a separate, support surface for writing. This is awkward particularly if no suitable support surface is conveniently available. Further, opening the looseleaf binder to remove a specific page to be written upon momentarily releases the remaining pages so that they can become loose and even fall out of the notebook. Accordingly, a person who uses the day planner on a consistent basis is required to write on pages that are not adequately supported on a suitable writing surface.

Various prior art devices are known for use in combination with notebooks. One such device is that of Jackel (German Patent No. 329,002) which is a page support system for a looseleaf notebook. The support system is used to elevate the outer edges of the pages above the inner edges apparently for the purpose of making the pages easier to read. Nothing in this reference is directed toward making the pages easier to be written upon.

Similar devices for elevating the outer edge of the pages are shown in the references of Sanabria (U.S. Pat. No. 4,880,327); Neilson (U.S. Pat. No. 2,309,474); and Elsden (German Patent No. 812,308).

Easel-type page support systems are shown by Jacobson (U.S. Pat. No. 4,240,761); Cirigliano (U.S. Pat. No. 3,091,482); and Gallo (French Patent No. 1,570,581).

Chinchar (U.S. Pat. No. 4,595,309) discloses a pad for a looseleaf notebook, the pad having an extended margin strip engageable with the rings of the looseleaf notebook.

In view of the foregoing it would be a significant advancement in the art to provide a writing surface for pages in a looseleaf notebook. It would also be an advancement in the art to provide a support surface for pages of a looseleaf notebook whereby the support surface can be selectively elevated to at least one of a plurality of elevated positions to support pages to be written upon and lowered into a flat, relatively unobtrusive position for storage. Such a novel apparatus and method is disclosed and claimed herein.

BRIEF SUMMARY AND OBJECTS OF THE INVENTION

This invention involves an adjustable, semirigid support surface or writing platform for looseleaf notebooks. The inner edge of the writing platform adjacent the ring binder can be elevated to provide an outwardly slanted support surface underneath the particular set of pages being written upon. The writing platform is configured to be either permanently or releasably mounted in the looseleaf notebook and includes a foldable riser for raising the edge of the writing platform adjacent the ring binder to at least one of a plurality of elevations above the plane of the underlying notebook outer binder. The outer edge of the writing platform remains at a position represented by the original position of the writing platform prior to its inner edge being elevated.

It is, therefore, a primary object of this invention to provide improvements in writing support surfaces for looseleaf notebooks.

Another primary object of this invention is to provide improvements in the method of providing support to a page of a looseleaf notebook.

Another object of this invention is to provide a writing platform for a looseleaf notebook whereby the inner edge of the writing platform can be elevated to a predetermined position to support a page being written upon and lowered into a relatively flat configuration for storage during periods of nonuse.

Another object of this invention is to provide a writing platform for a notebook, the notebook having a ring binder with the writing platform being selectively elevated to raise the inner edge of the pages adjacent the ring binder.

Another object of this invention is to provide a writing platform for selectively supporting pages to be written upon, the writing platform being capable of being elevated to more than one position.

These and other objects and features of the present invention will become more readily apparent from the following description in which preferred and other embodiments of the invention have been set forth in conjunction with the accompanying drawing and appended claims.

DETAILED DESCRIPTION OF THE PREFERRED EMBODIMENTS

Figure 1:
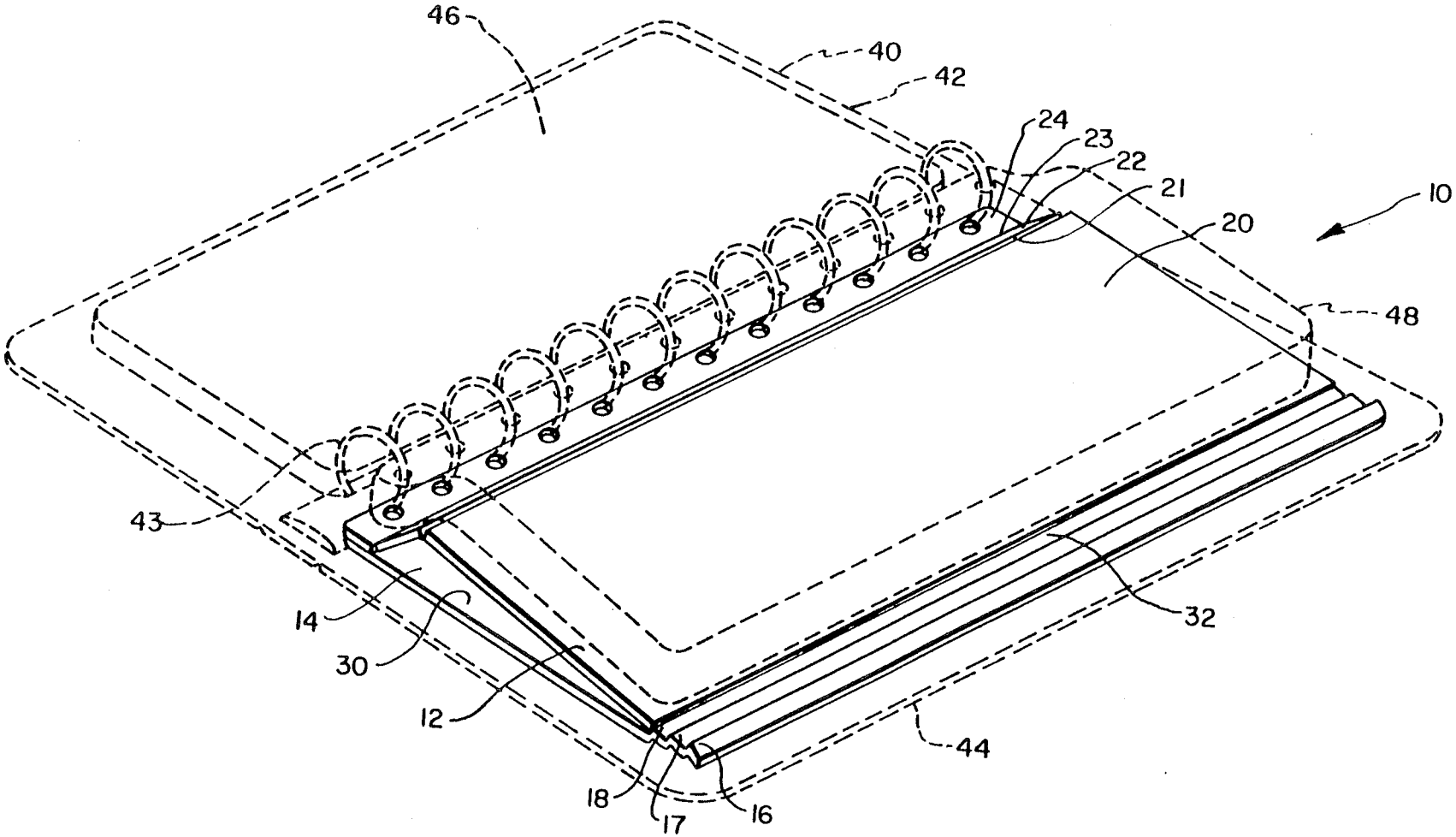
FIG. 1 is a perspective view of a first preferred embodiment of the novel writing platform of this invention shown in the environment of a looseleaf notebook.
Figure 2:
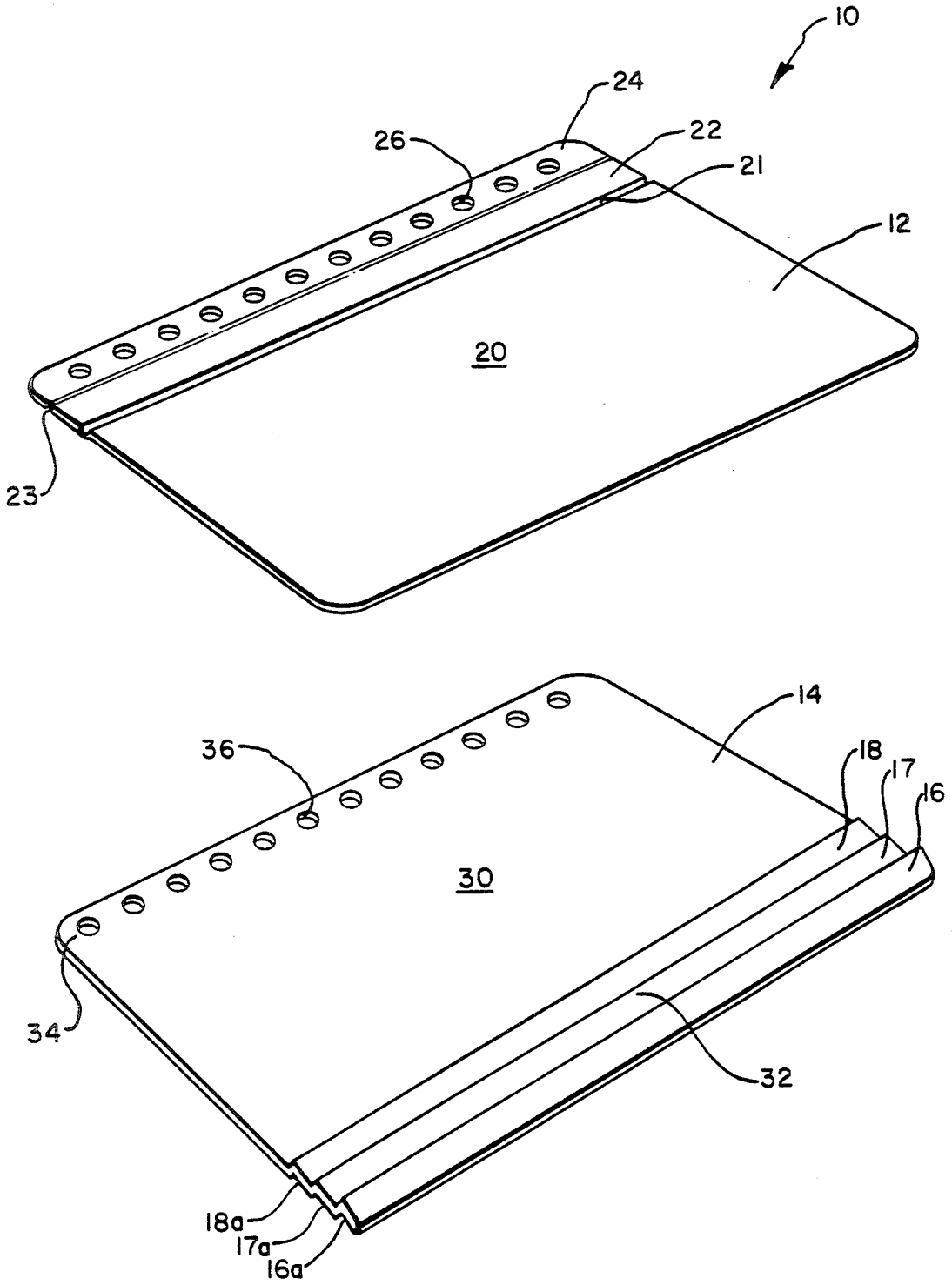
FIG. 2 is an exploded, perspective view of the first preferred embodiment of the writing platform of FIG. 1.

The invention is best understood by reference to the following description taken in conjunction with the accompanying drawing wherein like parts are designated by like numerals throughout.

General Discussion

The novel writing platform of this invention is designed to allow a person using a notebook to selectively elevate the inner edge of a portion of the pages in the looseleaf notebook to a predetermined elevation so as to accommodate the user being able to easily write upon the page so elevated. The writing platform is configured to elevate the pages adjacent the rings of the notebook to substantially eliminate interference by the rings. The overall configuration of the support is generally wedge-like.

The material of construction for the writing platform can be any suitable material of construction such as plastic, cardboard, leather, or wood; although the preferred material is plastic due to its having sufficient stiffness in addition to its characteristics of being readily formable, available, and relatively inexpensive. While numerous suitable plastics, such as polyethylene, polycarbonate, and the like, are available, polypropylene has been found to exhibit the desired features of allowing the writing platform in its various embodiments to be readily fabricated by injection molding techniques.

Another important feature for the plastic is its capability of being formed into what is referred to in the art as a "living hinge." This type of hinge is formed directly into the plastic using specialized molding techniques so that the plastic itself forms the hinge.

Detailed Description

Referring now to FIGS. 1-5, a first preferred embodiment of the novel writing platform of this invention is shown generally at 10 and in the environment of a looseleaf notebook 40 (shown in broken lines for ease of illustration). Writing platform 10 includes a writing table 12, a riser 22 and a basal element 14. Writing platform 10 is configured to be releasably engaged to rings 43 of looseleaf notebook 40. With specific reference to FIG. 2, writing table 12 includes a writing surface 20 hingedly joined to a riser 22 at a hinge 21. Riser 22 is, in turn hingedly joined to an upper retainer strip 24 at a hinge 23. Retainer strip 24 includes a plurality of spaced holes 26 which are configured to releasably receive rings 43 of looseleaf notebook 40.

Importantly, riser 22 is used to selectively elevate the inner edge of pages 48 (FIG. 1) adjacent rings 43 to thereby present pages 48 at a position where they are relatively free from interference with a writing hand (not shown). Only the inner edge of pages 48 are elevated and then only to a position sufficient to reduce the degree of interference by rings 43. The outer edge of pages 48 are not raised by the elevation of riser 22 so that the surface of pages 48 is a slanted surface extending downwardly from an upper portion of rings 43 toward the outer edge of back cover 44. This relatively slight slanting surface imparted to pages 48 does not represent an impediment to writing on pages 48. Further, it is an easy procedure to simply tilt notebook 40 until the surface of pages 48 is horizontal, if such a result is desirable.

Basal element 14 includes a basal surface 30 extending between a retainer edge 34 having therein a plurality of spaced holes 36 which, like holes 26, are configured to releasably engage rings 43 of looseleaf notebook 40. Basal element 14 includes a plurality of detents 16–18 molded into the outside edge of basal element 14. Detents 16–18 are formed by being created from grooves **16*a*–18*a* pressed upwardly into the bottom surface of basal element so as to create corresponding detents 16–18**.

Figure 4:
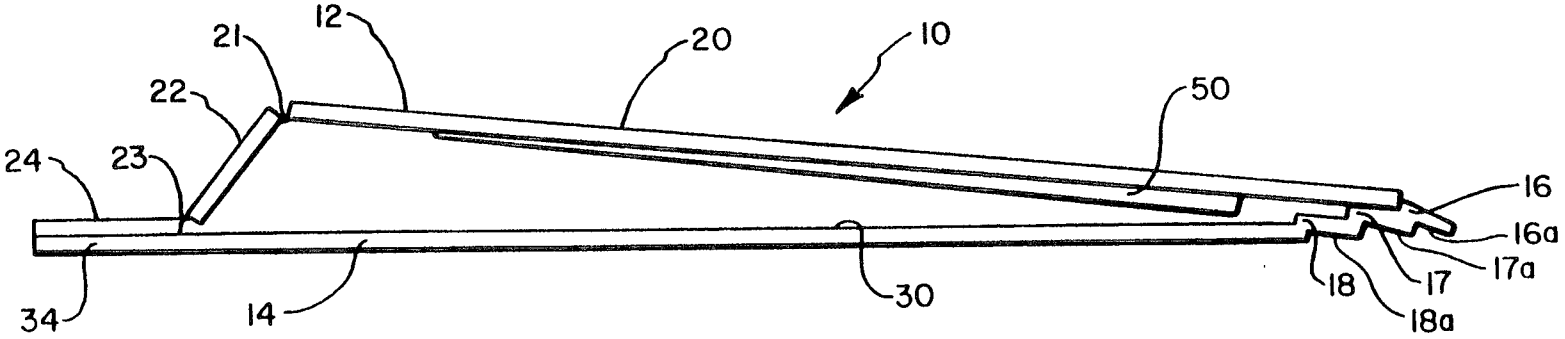
FIG. 4 is an end view of the first preferred embodiment of the writing platform shown in the raised configuration.
Figure 5:
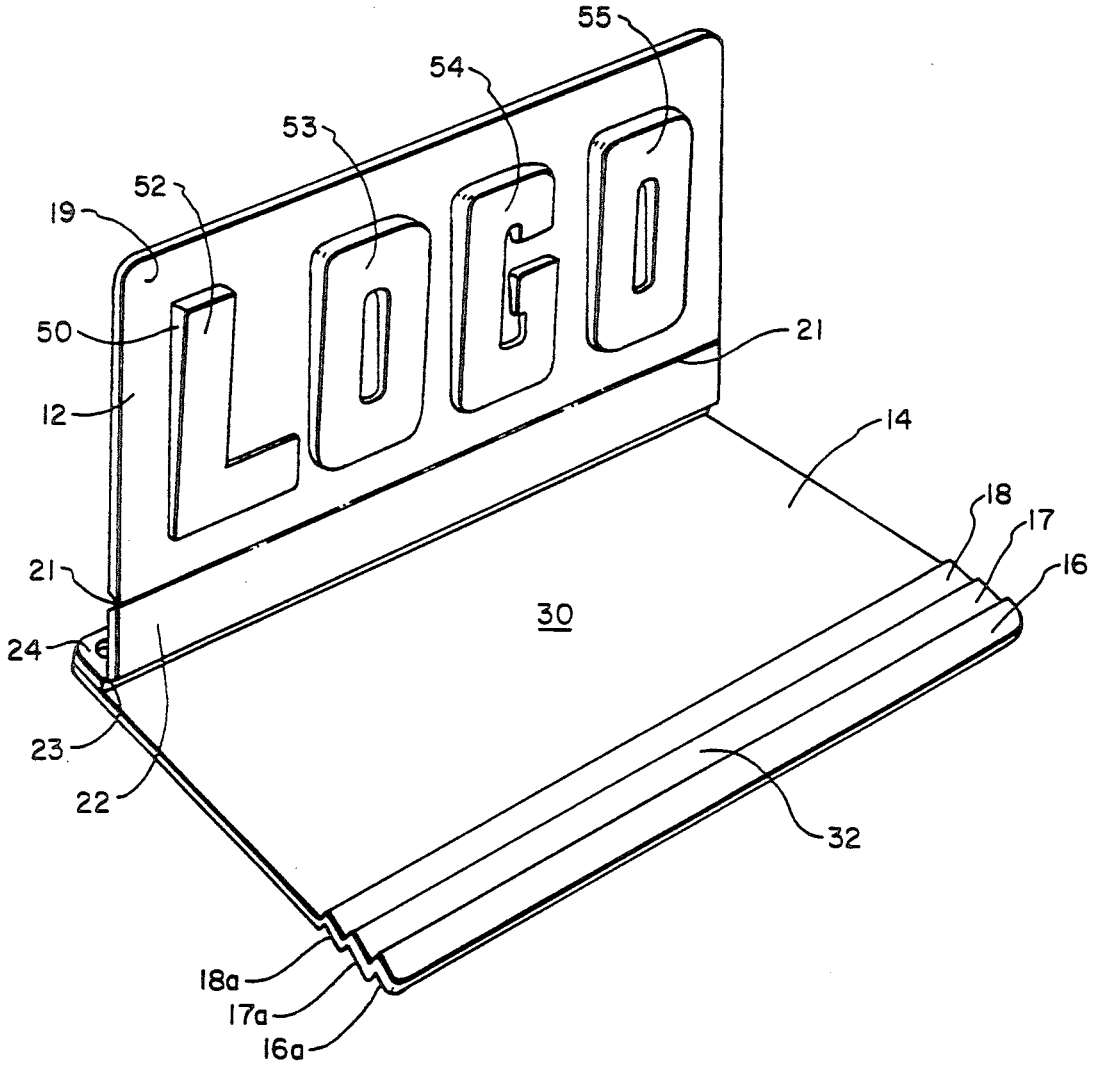
FIG. 5 is a perspective view of the first preferred embodiment of the writing platform shown with the writing surface in an opened configuration to illustrate the incorporation of a logo on the under side of the writing surface for purposes of providing rigidity to the writing surface.

Referring now more particularly to FIG. 5, writing table 12 is shown mounted to basal element 14 and writing surface 20 is raised so that a bottom surface 19 thereof is shown. Importantly, bottom surface 19 includes a raised indicia 50 shown herein as the word LOGO including letters 52–55 which represent the letters L, O, G, and O, respectively. Indicia 50 can be any suitable indicia but is specifically configured to lend rigidity or otherwise serve as a stiffener to writing table 12, or more specifically, writing surface 20 (FIGS. 1–4).

Figure 3:
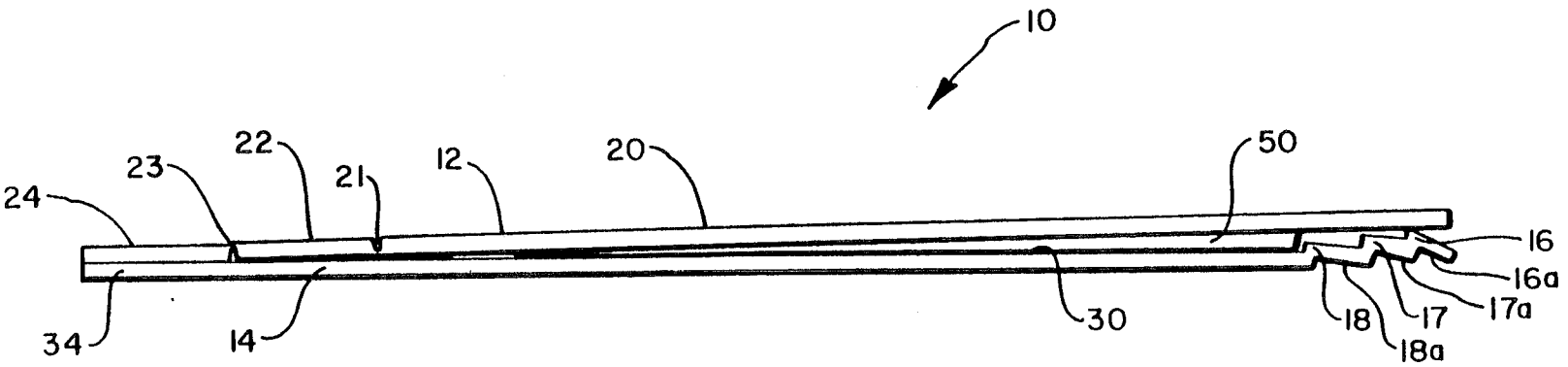
FIG. 3 is an end view of the first preferred embodiment of the writing platform shown in the flat configuration.

Referring now specifically to FIGS. 3 and 4, indicia 50 is shown in an end view of writing platform 10. In particular, it should be noted that writing table 12 rests on the top of detent 16 as shown in FIG. 3. Thus, a thin, wedge-like gap is formed in the space bounded by detent 18 on the right and retainer strip 24 on the left (between writing table 12 and basal element 14). Accordingly, indicia 50 is configured with a correspondingly dimensioned wedge-like profile so as to reside within the confines of the foregoing wedge-like gap. Indicia 50 thereby provides an increased degree of rigidity to writing table 12 without interfering with the juxtaposition of writing table 12 with basal element 14 as shown in FIG. 3.

Referring to FIGS. 1 and 4, writing table 12 is raised to an elevated position adjacent rings 43 by folding hinge 21 upwardly to orient riser 22 to a generally vertical position. Hinge 23 allows riser 22 to be oriented upwardly from retainer strip 24 so as to rigidly support the left edge of writing surface 20 while the right edge of writing surface is engaged with one of detents 16–18, in this instance, detent 16 (FIG. 4) or detent 18 (FIG. 1). The degree of elevation of writing surface 20 is selectively predetermined by the relative dimensional characteristics of the width of riser 22 and writing surface 20 as well as the widths and placement of detents 16–18.

Looseleaf notebook 40 includes a front cover 42, a back cover 44, and the set of rings 43 for holding a front set of pages 46 and a back set of pages 48 in the conventional manner of looseleaf notebooks. The number of pages in either of front set of pages 46 or back set of pages 48 is selectively variable so that it becomes necessary to be able to vary the degree of elevation of writing surface 20, as described hereinbefore. Further, writing platform 10 is readily adaptable to being mounted on either side of notebook 40. For example, as illustrated in FIG. 1, writing platform 10 is shown on the right side of notebook 40 underneath back set of pages 48 and in juxtaposition with back cover 44. Writing platform 10 can be placed under front set of pages 46 by removing it from rings 43 and reversing the orientation of writing platform 10 so as to place basal element 14 in juxtaposition with front cover 42 when again mounted on rings 43. Importantly, writing table 12 remains on top of basal element 14 so that the operation of writing surface 20 under front set of pages 46 is identical to its operation under back set of pages 48 as described hereinbefore. Everything remains the same except that writing platform 10 is switched end-for-end while retaining writing surface 20 in an upwardly oriented position.

Referring again specifically to FIG. 1, writing platform 10 is mounted on the right side of notebook 40 which means that it is configured to provide writing support for a person writing in notebook 40 with the left hand. In particular, writing platform 10 has raised the ring binder edge of pages 48 into a position where they are essentially flush with the top of rings 43. In this position, a left-handed writer (not shown) is able to write on pages 48 while experiencing minimal interference from rings 43.

Figure 6:
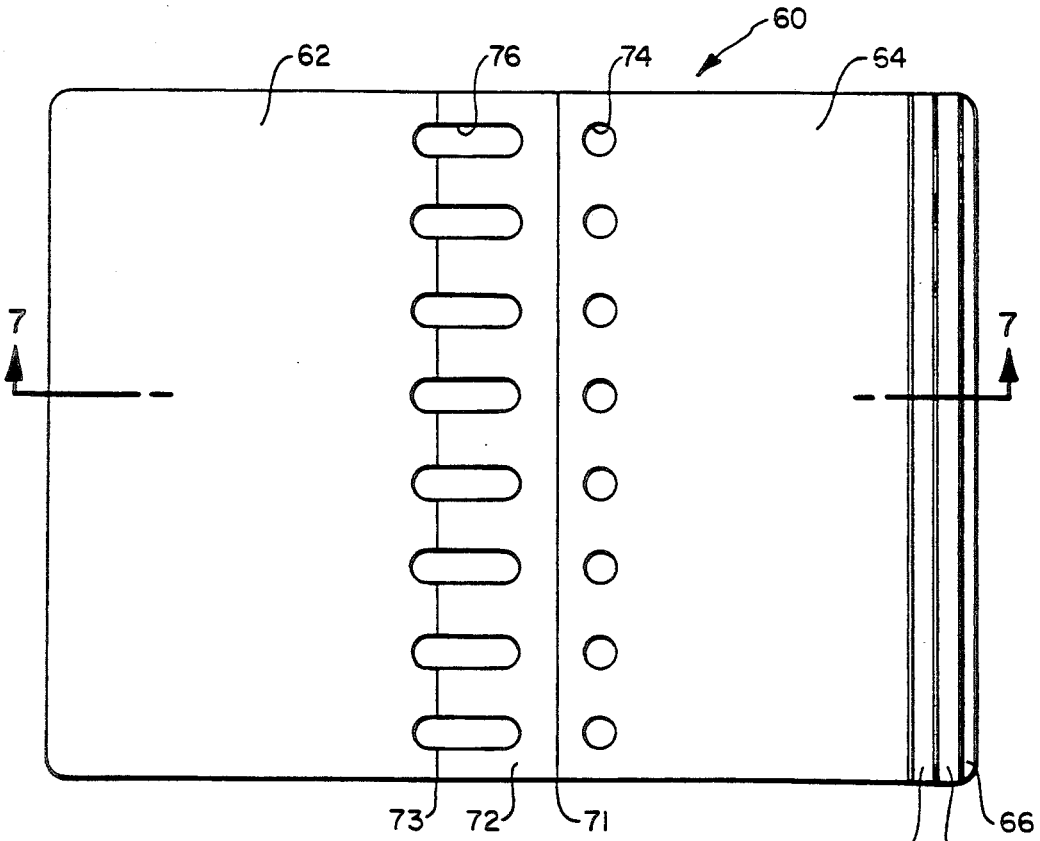
FIG. 6 is a plan view of a second preferred embodiment of the novel writing platform of this invention.
Figure 7:
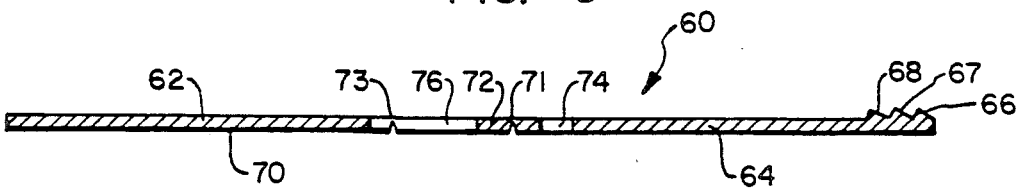
FIG. 7 is a cross sectional view taken along lines 7-7 of FIG. 6.
Figure 8:
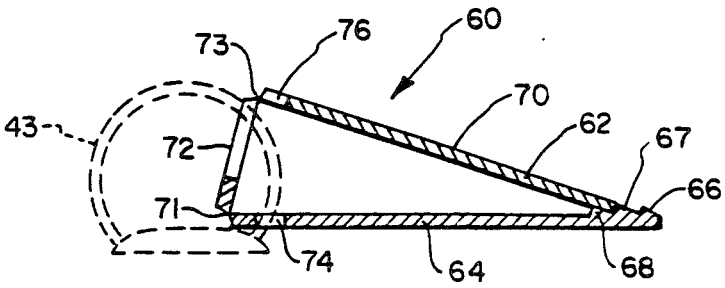
FIG. 8 is the cross sectional view shown in FIG. 7 but with the writing platform shown in the elevated position and in the environment of a ring binder for a looseleaf notebook.

Referring now to FIGS. 6–8, a second preferred embodiment of the novel writing platform of this invention is shown generally at 60 and includes a writing table 62 and a basal element 64 both of which are interconnected by a riser 72. A hinge 71 interconnects basal element 64 to riser 72 while a hinge 73 interconnects writing table 62 to riser 72. Writing platform 60 is specifically fabricated from a single panel of suitable construction material such as a rigid or semirigid plastic. Importantly, the plastic material must include the desirable feature of being compatible with the formation of hinges 71 and 73 therein. Such hinges are well known in the art and are used in numerous applications.

Writing platform 60 includes a plurality of spaced holes 74 along an edge of basal element 64. A corresponding plurality of spaced slots 76 extend an incremental distance through riser 72 into writing table 62 so as to accommodate a cooperative relationship with rings 43 (FIGS. 6–8). In particular, slots 76 allow riser 72 to be raised from a horizontal position (not shown) in juxtaposition with basal element 64 to the elevated position shown in FIG. 8. This allows writing table 62 to be raised to any of the positions regulated by detents 66–68 without having to remove writing platform 60 from rings 43. When folded to the flat configuration (not shown but similar to that shown in FIG. 3), riser 72 is brought downwardly until it rests against the left edge of basal element 64 with left end of slots 76 superimposed over holes 74 and the right edge of writing table 62 rests on detent 66.

Writing platform 60 is mountable on either side of rings 43 (see notebook 40, Figure so as to support the respective overlying pages in the manner described hereinbefore with respect to the first preferred embodiment of this invention, writing platform 10, shown in FIGS. 1–5. The principle difference is that writing platform 60 is fabricated from a single piece of plastic material that is folded upon itself as shown at FIG. 8 to provide the desired degree of elevation to writing surface 70. As illustrated in FIG. 8, writing platform 60 is mounted on the right side of rings 43 so that it is in position to elevate the left edge of pages 48 (FIG. 1) to the benefit of a person (not shown) writing thereon using the left hand.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A writing platform for a notebook having a ring binder comprising:

a writing table mountable on said ring binder in said notebook; and elevation means for elevating an inner edge of said writing table adjacent said ring binder while in said notebook to provide said writing platform, said elevation means elevating only said inner edge while an outer edge of said writing table is not elevated.

2. The writing platform defined in claim 1 wherein said writing table comprises a planar writing surface having a riser hingedly joined along said inner edge of said writing surface at a first hinge, said riser comprising a rigid strip and hingedly joined along its opposite edge to a retainer strip at a second hinge, said retainer strip mounting said writing table in said notebook at said ring binder with said riser elevating said inner edge incrementally relative to said ring binder.

3. The writing platform defined in claim 2 wherein said elevation means comprises a detent means for engaging said outer edge of said writing surface opposite said inner edge, said detent means being spaced from said retainer strip a predetermined distance so as to cause said riser to be angularly offset from said retainer strip at said second hinge and with said riser at a predetermined angle thereby elevating said inner edge of said writing surface an incremental distance at said first hinge.

4. The writing platform defined in claim 3 wherein said elevation means comprises a basal element joined along a first edge to said writing table at said retainer strip and having said detent means along a second edge spaced from and parallel to said first edge, said detent means comprising a plurality of detents spaced incrementally along said second edge, spacing of said detents being selectively predetermined in combination with the width of said riser so as to elevate said inner edge of said writing surface a predetermined distance relative to said ring binder adjacent said riser.

5. The writing platform defined in claim 1 wherein said writing table comprises a planar element having a first side and a second side, said first side having a plurality of detents adjacent a first edge and a plurality of spaced holes spaced from and parallel to said first edge, said spaced holes comprising retainer means for releasably mounting said planar element to said ring binder in a looseleaf notebook, the portion of said planar element between said detents and said spaced holes comprising a basal element, a riser adjacent said spaced holes, said riser being formed from said planar element between a first hinge and a second hinge, said first hinge being adjacent and parallel to said spaced holes and operable to allow said riser to be raised from the plane of said planar element at said first hinge, said second hinge being parallel to said first hinge and pivoting the remainder of said planar element to a position superimposed over said basal element, said remainder of said planar element comprising a writing surface with said second side exposed above said basal element, a portion of said riser and said writing surface comprising slots spaced from and coordinated with said spaced holes, each of said slots having a longitudinal axis perpendicular to the line of said spaced holes, said elevation means comprising said riser elevating said second hinge above said basal element when a second edge of said writing surface is engaged in said detent means.

6. The writing platform defined in claim 5 wherein said elevation means comprises adjustment means for adjustably positioning said writing surface by selectively spacing said detents so as to provide a plurality of positions to which said writing surface may be selectively raised.

7. The writing platform defined in claim 1 wherein said writing table comprises stiffener means on the underside of said writing surface.

8. The writing platform defined in claim 7 wherein said stiffener means comprises a raised lettering.

9. A writing platform for a notebook having a ring binder comprising:

a basal element mountable to said ring binder;

a writing table superimposed over said basal element;

elevation means for elevating an inner edge of said writing table adjacent the ring binder comprising a riser formed as a stiffened strip hingedly joined between said writing table and said basal element; and detent means for releasably supporting said riser in a generally vertical orientation relative to said writing table.

10. The writing platform defined in claim 9 wherein said basal element, said riser, and said writing table are formed from a planar element having a first side and a second side with said riser being formed in said planar element as a strip hingedly joined on a first edge at a first hinge to said basal element and on a second edge at a second hinge to said writing table, said writing table being folded at said second hinge so as to be superimposed over said basal element with said second side of said writing table forming a writing surface.

11. The writing platform defined in claim 10 wherein said basal element comprises mounting means for releasably mounting said basal element to a looseleaf notebook, said mounting means comprising a plurality of spaced holes adjacent said first hinge, said spaced holes being adapted to being engaged on rings of a ring binder of said looseleaf notebook, said riser and said writing table including a plurality of elongated slots spaced from and coordinated with said spaced holes, said slots passing over said rings in said spaced holes so as to allow said riser to be hingedly moved at said first hinge from a first position in juxtaposition on said basal element to a position angularly offset from said basal element and supporting said writing surface above said basal element.

12. The writing platform defined in claim 11 wherein said detent means comprises detents on said basal element for releasably engaging an edge of said writing table opposite said riser.

13. The writing platform defined in claim 10 wherein said writing table comprises stiffener means beneath said writing surface.

14. The writing platform defined in claim 10 wherein said stiffener means comprises a logo formed as a raised surface; said raised surface imparting a limited degree of increased stiffness to said writing table.

15. A method for providing a writing platform in a notebook having a ring binder comprising:

preparing a basal element by forming a plurality of spaced, ring-receiving holes for rings of said ring binder;

mounting said basal element in said notebook by engaging said rings in said holes;

forming a writing table as a planar surface superimposed over said basal element;

selecting a riser for said writing table comprising a strip of rigid material hingedly joined along a edge to said writing table, the width of said strip determining the maximum distance said writing table can be elevated above said basal element;

engaging said riser to said notebook adjacent said rings; and elevating said writing platform in said notebook by raising said riser with said riser supporting said edge of said writing table above said basal element.

16. The method defined in claim 15 wherein said preparing step, said forming step and said selecting step all comprise fabricating said basal element, said writing table, and said riser from a unitary planar element with a first hinge between said basal element and said riser and a second hinge between said riser and said writing table, said second hinge folding said writing table into superposition over said basal element.

17. The method defined in claim 15 wherein said elevating step comprises providing detent means for releasably supporting said riser.

18. The method defined in claim 17 wherein said providing step comprises forming said detents in said riser for releasably engaging said riser to said rings.

* * * * *